US007156695B2

(12) United States Patent
Holliday

(10) Patent No.: US 7,156,695 B2
(45) **Date of Patent: *Jan. 2, 2007**

(54) ADAPTER FOR COAXIAL CABLE WITH INTERCHANGEABLE COLOR BANDS

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

This patent is subject to a terminal disclaimer.

(21) Appl. No.: 11/111,198

(22) Filed: Apr. 20, 2005

(65) Prior Publication Data

US 2005/0186840 A1 Aug. 25, 2005

Related U.S. Application Data

(63) Continuation of application No. 10/654,808, filed on Sep. 3, 2003, now Pat. No. 6,935,892, which is a continuation-in-part of application No. 10/313,787, filed on Dec. 6, 2002, now Pat. No. 6,805,583, and a continuation-in-part of application No. 10/616,273, filed on Jul. 8, 2003, now Pat. No. 6,830,479.

(51) Int. Cl.
*H01R 9/05* (2006.01)

(52) U.S. Cl. ..... 439/584; 439/585

(58) Field of Classification Search ..... 439/578–585, 439/488

See application file for complete search history.

(56) References Cited

U.S. PATENT DOCUMENTS

| | | | | |
|---|---|---|---|---|
| 3,601,524 | A | 8/1971 | Kauffman | |
| 4,280,748 | A | 7/1981 | McHenney et al. | |
| 4,932,897 | A | 6/1990 | Lee et al. | |
| 5,232,377 | A | 8/1993 | Leibfried et al. | |
| 5,392,508 | A | 2/1995 | Holliday et al. | |
| 5,480,325 | A | 1/1996 | Tran et al. | |
| 5,529,513 | A | 6/1996 | Lee | |
| 5,548,088 | A | 8/1996 | Gray et al. | |
| 5,596,800 | A | 1/1997 | Holliday et al. | |
| 5,641,306 | A | 6/1997 | Sterniak | |
| 5,651,698 | A | 7/1997 | Locati et al. | |
| 5,769,662 | A | 6/1998 | Stabile et al. | |
| 5,938,465 | A | 8/1999 | Fox, Sr. | |
| 6,027,373 | A | 2/2000 | Gray et al. | |
| 6,146,197 | A | 11/2000 | Holliday | |
| 6,153,830 | A | 11/2000 | Montena | |
| 6,159,046 | A | 12/2000 | Wong | |
| 6,179,656 | B1 | 12/2000 | Wong | |
| 6,352,448 | B1 * | 3/2002 | Holliday et al. | 439/585 |
| 6,406,330 | B1 | 6/2002 | Bruce | |
| 6,443,759 | B1 * | 9/2002 | Matsuda et al. | 439/488 |

(Continued)

OTHER PUBLICATIONS

"Monster Cable with Elastomer Band Eng. Proj-H5" by Monster Cable Products, Inc. Jul. 31, 2003.

*Primary Examiner*—Gary F. Paumen
(74) *Attorney, Agent, or Firm*—John E. Reilly; Ellen Reilly

(57) ABSTRACT

A termination assembly for a coaxial cable is made up of an extension tip which receives the inner conductor pin on the cable, and an adapter having a slotted end surrounds an outer jacket as well as an exposed end of the outer conductor and is compressed into firm engagement with the jacket, all as a preliminary to inserting the assembly into a standard sized connector body and avoid creating impedance which will downgrade the signal passing through the cable into the connector. Color bands are utilized to signify the intended application of the connector to a particular application as well as to represent the cable size for which the connector body is designed.

14 Claims, 5 Drawing Sheets

U.S. PATENT DOCUMENTS 6,517,379 B1 2/2003 Leve
6,551,127 B1 4/2003 Li et al.
6,659,811 B1 * 12/2003 Okamoto et al. ..... 439/752
6,719,585 B1 * 4/2004 Egbert ..... 439/578
6,743,044 B1 * 6/2004 Musolf et al. ..... 439/490
6,773,303 B1 * 8/2004 Lin ..... 439/578
6,796,829 B1 * 9/2004 McCarthy ..... 439/394

* cited by examiner

ADAPTER FOR COAXIAL CABLE WITH INTERCHANGEABLE COLOR BANDS

CROSS-REFERENCE TO RELATED APPLICATIONS

This application is a continuation of patent application Ser. No. 10/654,808, filed 3 Sep. 2003 for ADAPTER FOR MINI-COAXIAL CABLE by Randall A. Holliday and incorporated by reference herein, which is a continuation-in-part of patent application Ser. No. 10/313,787, filed 6 Dec., 2002 for MINI-COAXIAL CABLE CONNECTOR by Randall A. Holliday and Sheng Chia Wong and incorporated by reference herein, now U.S. Pat. No. 6,805,583, granted 19 Oct., 2004; and this application is a continuation-in-part of patent application Ser. No. 10/616,273, filed 8 Jul., 2003, for UNIVERSAL CRIMPING CONNECTOR by Randall A. Holliday, now U.S. Pat. No. 6,830,479, incorporated by reference herein.

BACKGROUND

In one aspect, a termination assembly or adapter for coaxial cable end connectors that is used in splicing a cable to another cable or connecting to a post or terminal.

The problems associated with the connection of mini-coax cables as well as larger size cables to a post or terminal in the field are discussed at some length in hereinabove referred to U.S. Pat. No. 6,805,583 for MINI-COAXIAL CABLE CONNECTOR and in U.S. Pat. No. 6,352,448 for CABLE TV END CONNECTOR STARTER GUIDE. The following is directed to further improvements in termination assemblies to be employed for mini-coaxial cables in which the termination assembly is characterized in particular by being comprised of a minimum number of parts which can be quickly assembled at the manufacturing site as well as in the field and is particularly useful for connection of a mini-coaxial cable to an RCA connector.

SUMMARY

It is therefore an object to provide for a novel and improved adapter for coaxial cables; also a novel and improved adapter for small diameter coaxial cables which can be installed in the field in a minimum number of steps with minimal tooling required. It is desirable to provide for a novel and improved adapter for coaxial cable installations which assures accurate alignment between the cable and connector preliminary to crimping of the connector onto the cable and prevents shorting between the cable layers with one another as well as with conductive portions of the connector; and to provide for a novel and improved adapter for preparing the end of a coaxial cable for installation into an end connector having a preassembled crimping ring.

An adapter is provided for connecting the end of a coaxial cable to a hollow connector body wherein the cable is of the type having inner and outer concentric electrical conductors, an annular dielectric separating the conductors and an outer jacket of electrically non-conductive material, the inner and outer conductors being exposed and the inner conductor projecting beyond the dielectric at one end of the cable; and the adapter comprises at least one sleeve having a conductive portion surrounding the outer conductor, an electrically nonconductive portion surrounding the dielectric layer and with an opening at its leading end for mounting of an extension tip into electrical contact with the inner conductor. In one form, the one sleeve may be provided with an enlarged opening with respect to the dielectric layer to permit insertion of a second sleeve therebetween which will assist in centering and alignment of the inner conductor. The one sleeve is dimensioned such that a crimping ring, for example, for an RCA connector will cause the sleeve to be compressed into sealed engagement with the dielectric layer and will insulate the outer braided layer from shorting, and the trailing end of the one sleeve is slotted to form prong-like segments having internal and external teeth so that the trailing end of the sleeve can be compressed into engagement with the cable without crushing the dielectric layer.

It is therefore to be understood that even though numerous characteristics and advantages of the present invention have been set forth in the foregoing description, together with details of the structure and function of the adaptor, the disclosure is illustrative only, and changes may be made to the full extent indicated by the broad general meaning of the terms in which the appended claims are expressed and reasonable equivalents thereof.

The above and other objects, advantages and features of the present invention will become more readily appreciated and understood from a consideration of the following detailed description of preferred and modified forms of the present invention when taken together with the accompanying drawings in which:

DETAILED DESCRIPTION OF FIRST EMBODIMENT

Figure 1:
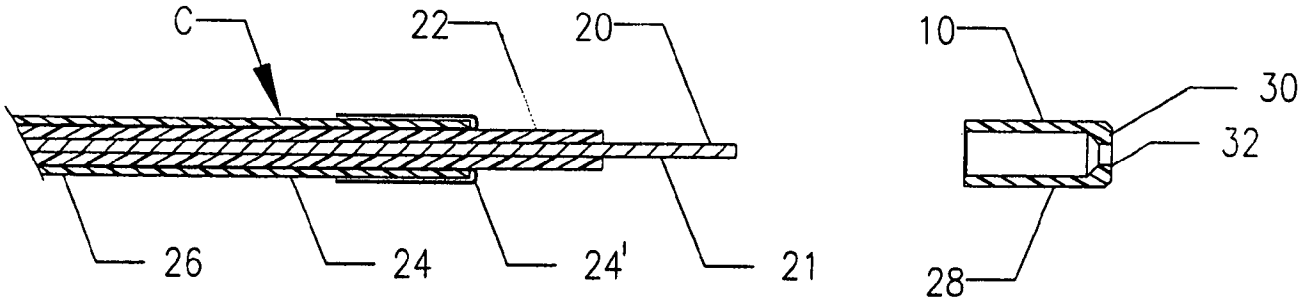
FIG. 1 is an exploded view in section of a mini-coax cable and one form of intermediate sleeve in accordance with the present invention.
Figure 2:
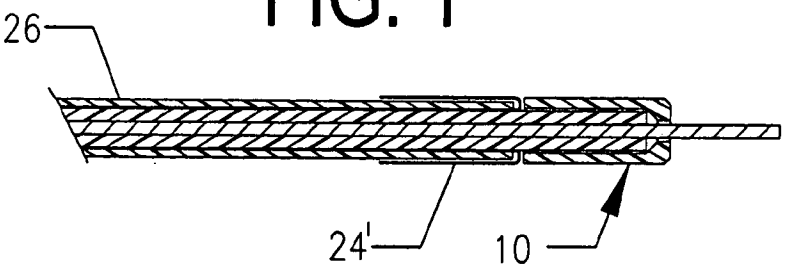
FIG. 2 is an exploded view in section of the cable and sleeve shown in FIG. 1 in assembled form.

Referring in more detail to the drawings, there is illustrated in FIGS. 1 to 8 a first embodiment which is broadly comprised of a standard coaxial cable C, sleeves 10 and 12, an RCA type of cable connector 14, and an extension tip 16.

As a setting, the cable C is comprised of an inner conductor pin or wire 20 which is surrounded by a dielectric insulator 22 of electrically non-conductive material, such as, a rubber or rubber-like material, a braided conductor layer 24, and an outer jacket 26 of an electrically non-conductive material, such as, a rubber or rubber-like material. The end of the cable C is further prepared for assembly by removing a limited length of the jacket 26 and braided conductor 24 as well as the insulated layer 22 in order to expose an end of the pin 20 along with foil layer 21 surrounding the pin 20. The braided conductor layer 24 is peeled away from the insulator 22 and doubled over as at 24' to cover the leading end of the jacket 26.

As shown in FIG. 1, the sleeve 10 has a thin-walled, hollow cylindrical body 28 of uniform thickness throughout its length and terminating in an annular end wall 30 provided with a central bore 32. The sleeve 10 is dimensioned such that the wall 28 will fit snugly over the insulator layer 22 until its trailing end abuts the end of the doubled over layer 24', and the pin 20 will extend through the bore 32 with the end wall 30 abutting the end of the layer 22. For this purpose, the layer 22 is exposed for a length corresponding to the length of the wall portion 28 of the sleeve 10 when assembled in the relationship shown in FIG. 2.

Figure 3:
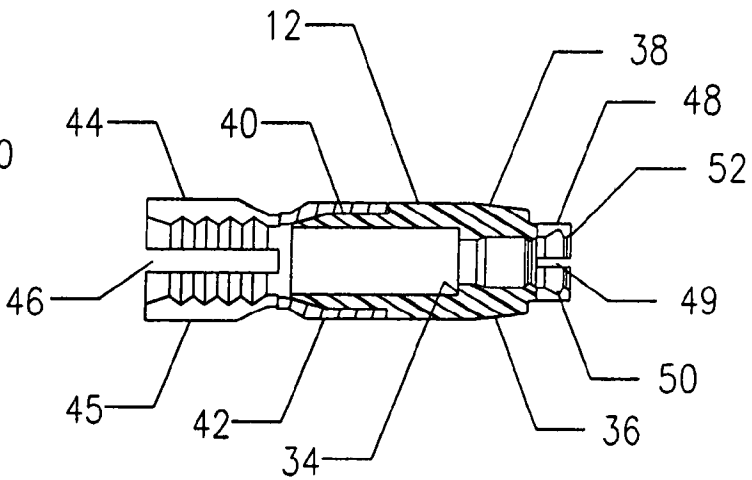
FIG. 3 is an exploded view in section of the assembly shown in FIG. 2 and an outer sleeve adapted to receive the assembly of FIG. 2.
Figure 3:
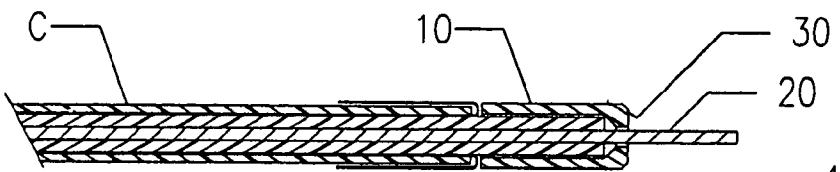
Figure 4:
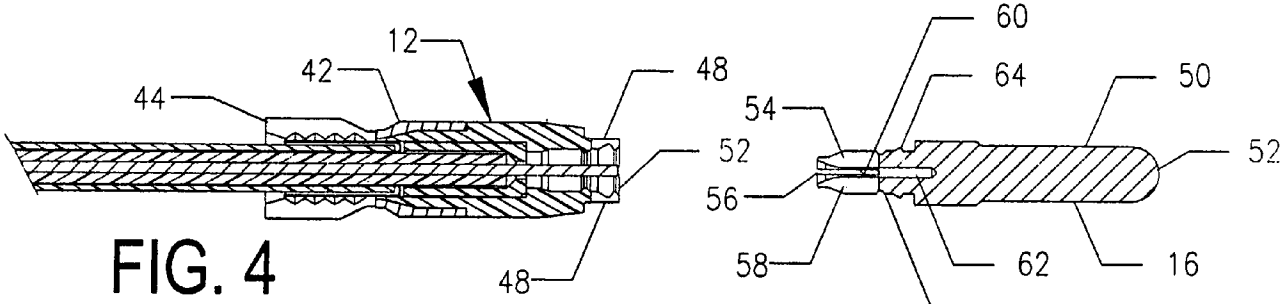
FIG. 4 is another exploded view in section of the assembly shown in FIG. 3 and an extension tip.

Referring to FIG. 3, the assembled cable C and sleeve 10 are adapted to be inserted into a sleeve 12 until the end wall 30 abuts an internal shoulder 34 and the pin 20 projects through the remaining length of the sleeve 12 into the relationship shown in FIG. 4. The sleeve 12 is of two-piece construction including an elongated tubular portion 36 of electrically non-conductive material with an outer generally convex wall surface 38 which is undercut at 40 to receive a relatively thin-walled sleeve 42 of electrically conductive material. The sleeve 42 diverges into relatively thick arcuate end portions 44 which are separated by longitudinally extending slots 46. The opposite end 36 of the tubular portion 34 has an inner wall surface 37 which diverges into a thin-walled annular end retainer 48. The retainer 48 is slotted at circumferentially spaced intervals, such as, at 49 and is provided with an internal circumferential groove 50 directly behind a beveled edge 52.

As best seen from FIG. 4, the assembled cable C and sleeve 10 are inserted into the outer sleeve 12 until the end wall 30 abuts the internal shoulder 34 and the slotted segments 44 are positioned over the doubled over layer 24' and jacket 26. In this relation, the pin 20 will project through the relatively thick-walled end of the tubular portion 36 and terminate at the entrance to the end retainer 48.

Figure 5:
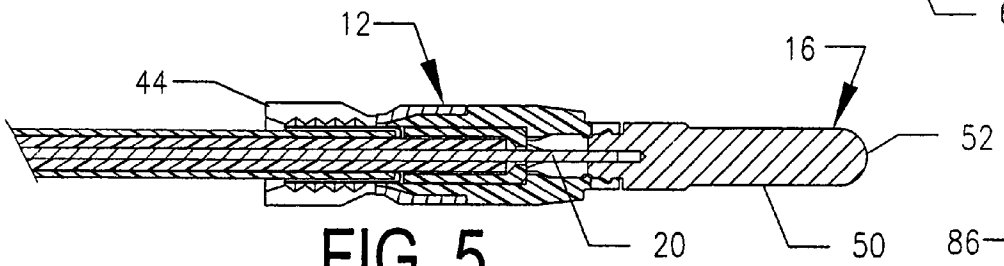
FIG. 5 is a view in section illustrating the extension tip of FIG. 4 inserted into the end of the sleeve.

The extension tip 16 is illustrated in FIG. 4 prior to its connection to the end retainer 48. The extension tip 16 is made up of a solid, elongated cylindrical metal body 50 terminating in a nose 52 at one end and in a slotted end portion 54 at its opposite end. The slotted end 54 includes longitudinal slots 56 dividing the end portion into arcuate segments 58 and together forming a common central opening 60 which is aligned and communicates with a bore 62 in the end of the solid extension portion 50. An external shoulder or ridge 64 extends circumferentially around a reduced end portion 66 of the body 50, and the external ridge 64 is dimensioned to be of a slightly greater diameter than the beveled edge 52 so as to force the end retainer 48 to expand slightly until the ridge 64 moves into press-fit engagement with the groove 52. The slotted end 54 is of a diameter to advance forwardly through the inner wall 37 of the tubular portion 36 and permit advancement of the pin 20 through the central opening 60 and 62, as illustrated in FIG. 5.

It is important to dimension the width of the slots 46 to limit the amount of contraction of the segments 44 so that the teeth 45 will compress the jacket 26 enough to prevent pull-out but not enough to crush the dielectric layer 22. This is especially important in cables operating at higher bandwidth frequencies in which any bending or crushing of the dielectric can create an impedance that downgrades the signal and prevents good return loss.

Figure 6:
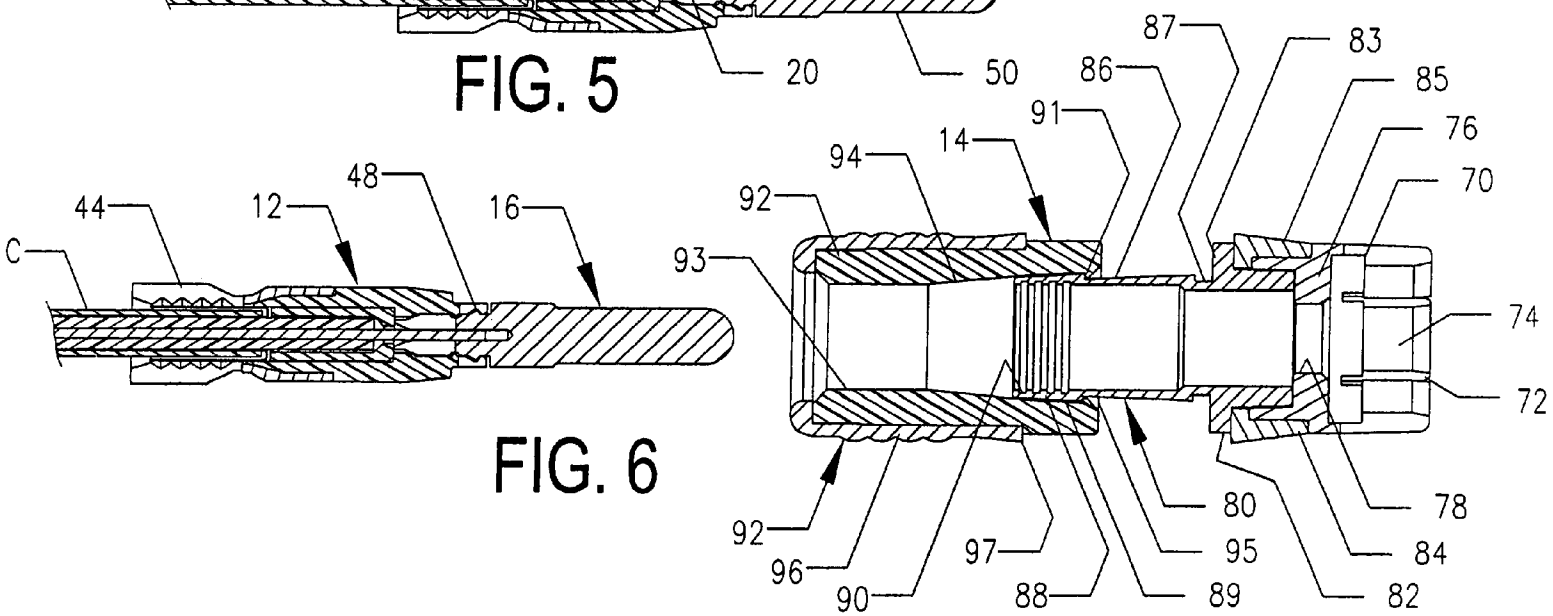
FIG. 6 is an exploded view in section of the assembly shown in FIG. 5 and a coaxial cable connector housing.
Figure 7:
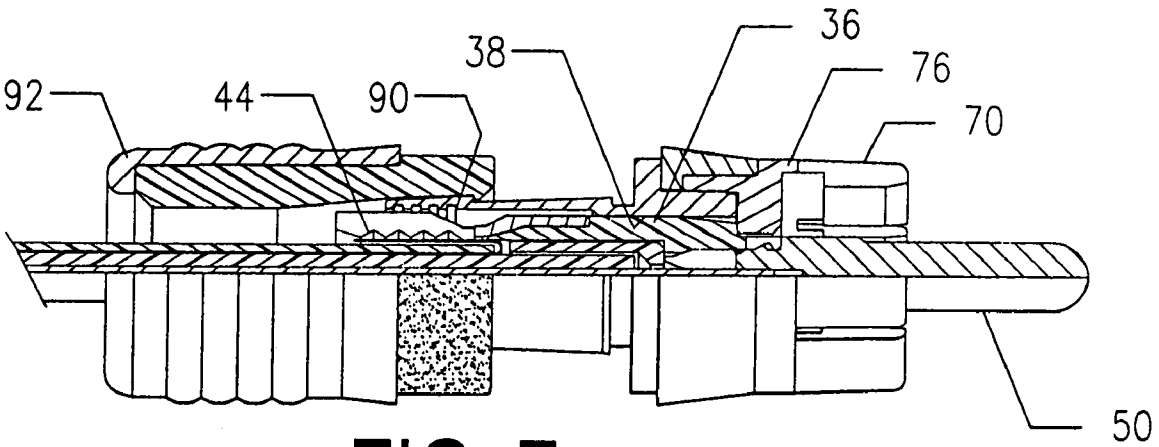
FIG. 7 is a view partially in section of the parts shown in FIG. 6 in assembled form prior to crimping.
Figure 8:
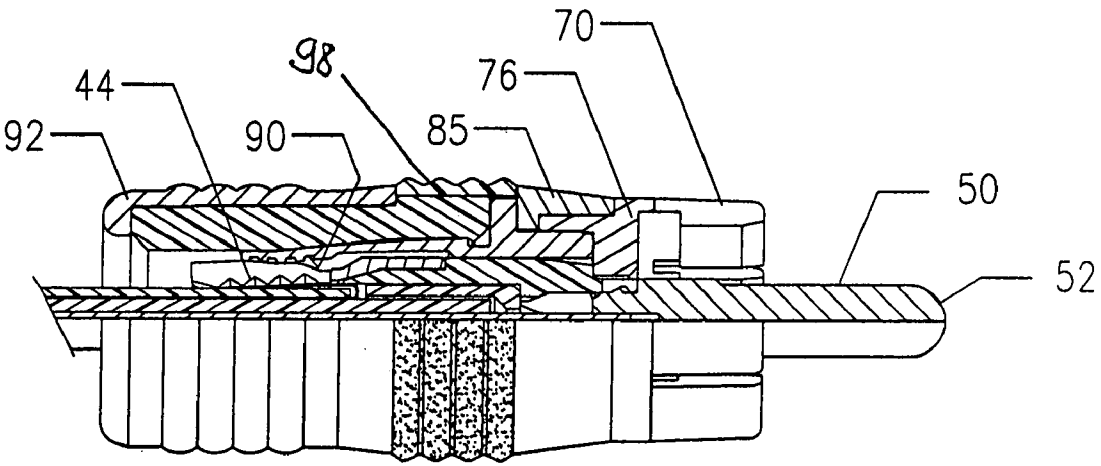
FIG. 8 is a view partially in section illustrating the assembly of FIG. 7 after the crimping operation.
Figure 8A:
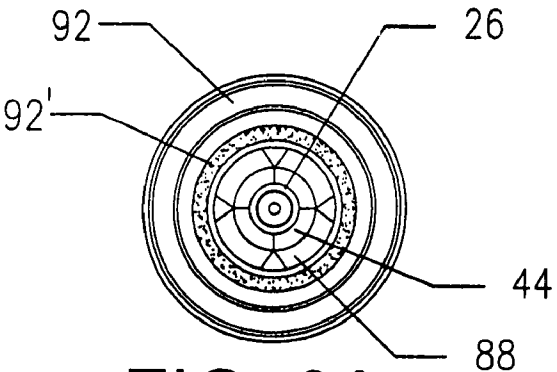
Figure 9:
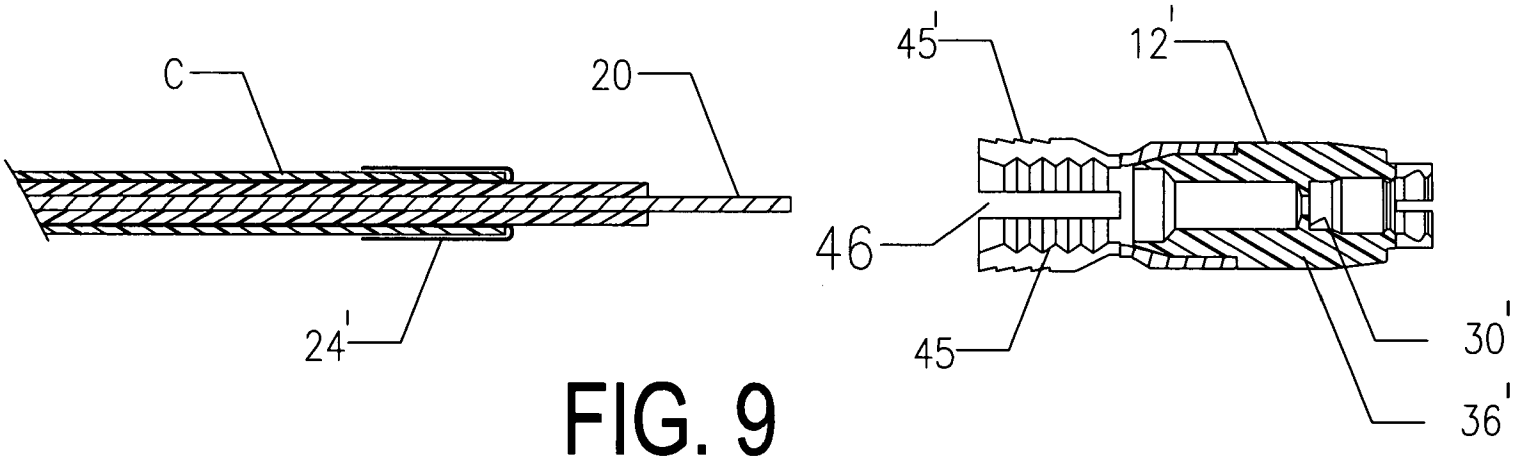
FIG. 9 is an exploded view in section of another form of invention illustrating a mini-coax cable and a sleeve prior to assembly.
Figure 10:
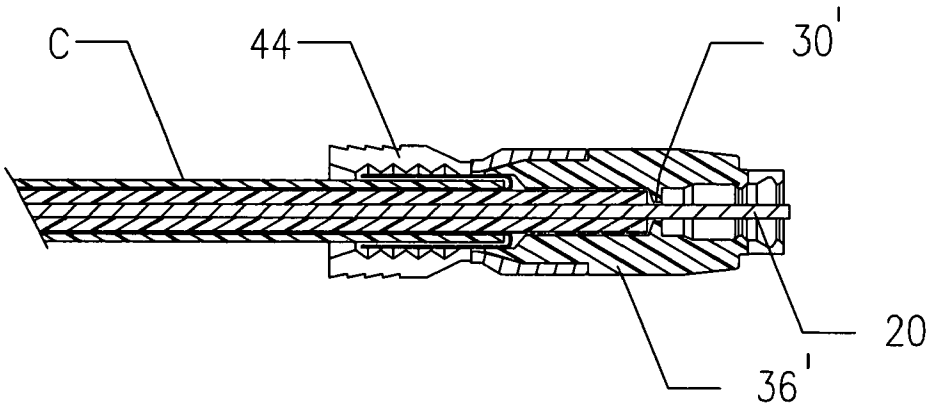
FIG. 10 is another view in section of the cable and sleeve shown in FIG. 9 in assembled form.
Figure 11:
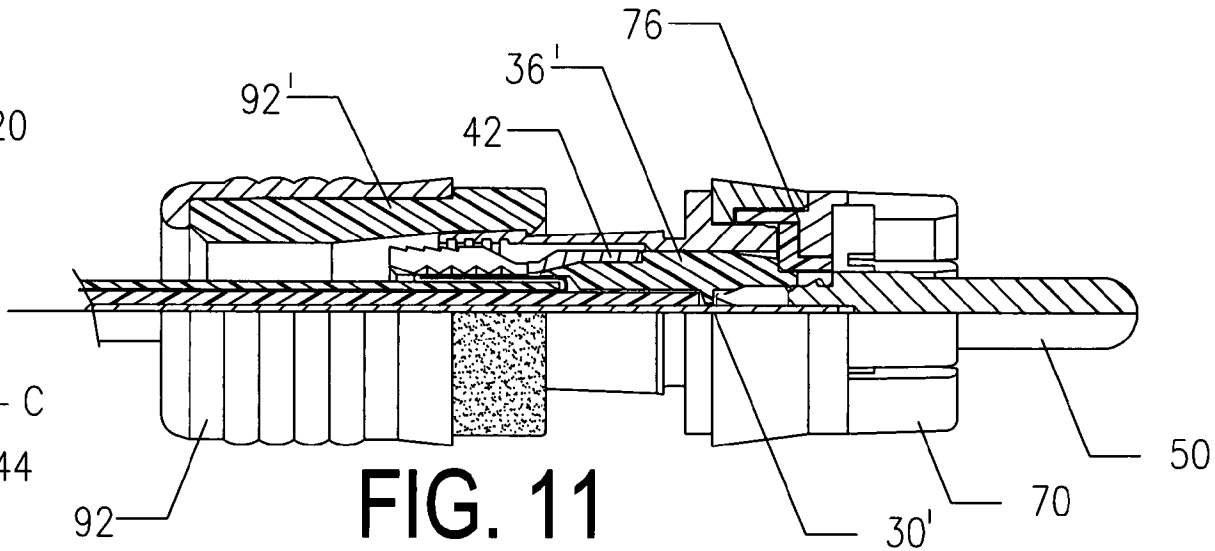
FIG. 11 is a view partially in section of the assembly shown in FIG. 10 inserted into a cable TV connector.

FIGS. 6 to 8 illustrate the manner in which the termination assembly comprising the cable C, sleeve 12 and extension tip 16 are installed in a CATV connector 14 which is of the RCA type for mini-coaxial cables. The connector 14 is made up of a ferrule 70 which is slotted as at 72 into spring-like segments 74 to facilitate attachment to a post or terminal. An annular base portion 76 of the ferrule 70 forms a central opening or passage 78 for insertion of the tip 16 beyond the end of the ferrule, as shown in FIGS. 7 and 8, and an elongated tubular member 80 has one end 82 mounted in the base 76. A keeper 84 of annular configuration is mounted between the base 78 and an external shoulder 83 on the end portion 82, the keeper provided with an external shoulder 85 which projects radially outwardly of the shoulder 82 and tapers forwardly into flush relation to the external surface of the ferrule 70. Again, the elongated tubular member 80 extends rearwardly from the shoulder portion 82 to define a first sleeve portion 86 which tapers rearwardly away from a circumferential groove or notch 87 and terminates in a thickened annular end 88 which has a rearwardly tapered outer wall surface 89 and endless ribs or sealing rings 90 on its inner wall surface.

The thickened end 88 of the sleeve 80 also defines an external shoulder 91 to facilitate mounting of a crimping ring 92 in a manner to be described.

The crimping ring 92 is of a type that can be preassembled on the connector 14 and axially advanced over the sleeve 80 to force it into crimping engagement with the slotted end 44 of the sleeve 42. To this end, the crimping ring 92 is made up of an annular body 92' composed of a low-friction material having limited compressibility, such as, DELRIN® or other hardened plastic material. The body has a straight cylindrical portion 93 and a forwardly tapered portion 94 which terminates in a leading end having an internal shoulder or rib 95. The forwardly tapered portion 94 is complementary to the external tapered wall surface 89 on the end portion 88 so that the crimping ring 92 can be axially advanced over the end of the sleeve 80 until the internal shoulder 95 advances past the shoulder 91, as shown in FIG. 6, to preassemble the ring 92 onto the connector 14.

An exterior surface of the body 92' is recessed or undercut to receive a reinforcing band 96 which is preferably composed of brass and which fits snugly over the body 92'. The leading end 97 of the band 96 projects outwardly beyond the external surface of the body to define an external shoulder of a diameter corresponding to that of the trailing edge of the tapered surface portion 85.

Figure 7A:
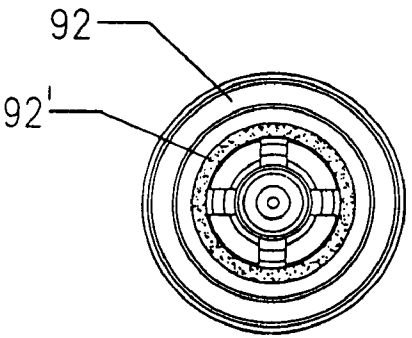
FIG. 7A is an end view of FIG. 7.

Referring to FIGS. 7 and 7A, the termination assembly is inserted into the connector until the leading edge of the tubular portion 36 abuts the base 76 of the ferrule, the external surface 38 of the tubular portion contacting the inner wall surface of the end portion 82 of the sleeve 80 and the segments 44 being aligned with the sealing rings 90.

A standard crimping tool is employed to axially advance the crimping ring 92 over the sleeve 80 until the leading end or rib 95 moves into snap-fit engagement with the groove 87 and abuts the shoulder 83. The tapered surface 94 will cause the end portion 88 to radially contract and force the sealing ribs 90 into positive engagement with serrations or teeth 45 on the segments 44 and in turn cause the segments 44 to be crimped into positive engagement with the jacket 26 as well as the braided portion 24'. One such crimping tool is disclosed in U.S. Pat. No. 6,708,396 for UNIVERSAL CRIMPING TOOL and is incorporated by reference herein. The cooperation between the ribs 90 when forced into the teeth 45 and in turn forcing the internal teeth 45 into engagement with the braided layer 24' as well as the jacket 26 increases the pull-out strength of the termination assembly both with respect to the end of the cable C and the connector 14.

DETAILED DESCRIPTION OF SECOND EMBODIMENT

Mini-coaxial cables are particularly useful in cellular telephones, security cameras and other applications where there are decided space limitations or where short runs of cable are used. It will be evident that the size and proportion of the sleeves 10 and 12 may be varied according to specific wire or cable diameters and be proportioned according to the space allowances between the cable C and the connector 14. For example, as illustrated in FIGS. 9 to 12, a modified form of invention effectively eliminates the sleeve 10 and increases the thickness of the tubular portion 36' compared to that of the tubular portion 36 shown in FIGS. 1 to 8. In addition, an annular guide 30' extends across the tubular portion 36' to cooperate in limiting the forward extension of the cable C into the sleeve and to guide the pin 20.

The width of the slots 46 and 46' referred to in the First and Second Embodiments may be varied in accordance with the amount of contraction required of the segments 44 or 44', respectively, to firmly engage the jacket 26 without crushing the dielectric layer 22. In addition, the segments are provided with internal and external teeth 45 and 45', respectively.

It will be evident that the crimping tool referred to in the first embodiment and which is described in more detail in my hereinbefore referred to application for UNIVERSAL CRIMPING TOOL is equally effective in crimping the connector 14, sleeve 12 and cable C together. At the same time, the complementary tapered surfaces between the crimping ring 92' and sleeve 80 permit utilization of one size connector 14 in crimping different sized cables C. The only modification required is to the inner diameter of the sleeve 12 and adjusting the width of the slots 46 and 46' to properly engage the jacket 26 of the cable without crushing the layer 22 as previously discussed. The termination assembly also can be utilized in cooperation with U.S. Pat. No. 6,783,394 for UNIVERSAL MULTI-STAGE COMPRESSION CONNECTOR.

Figure 12:
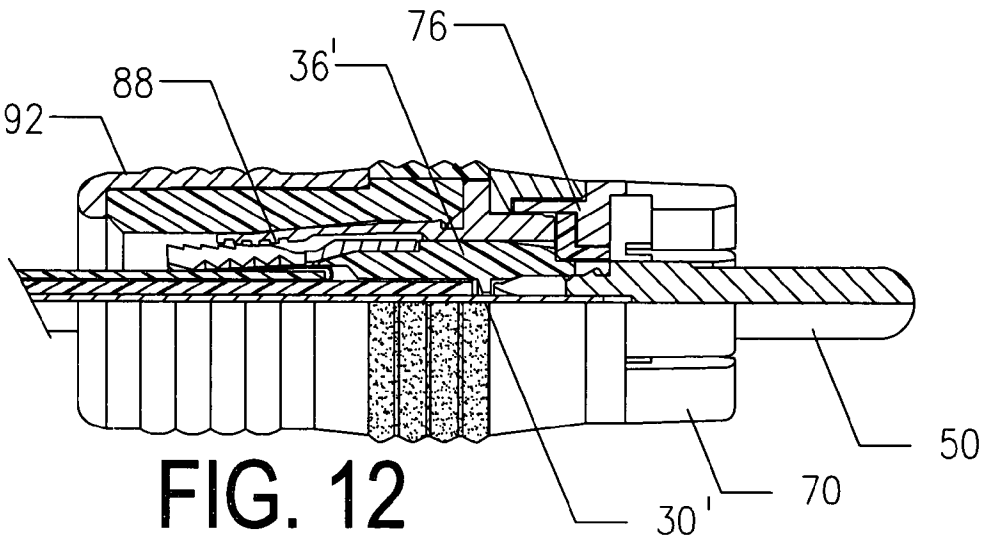
FIG. 12 is a view partially in section illustrating the assembly of FIG. 11 after the connector has been crimped onto the cable.
Figure 11A:
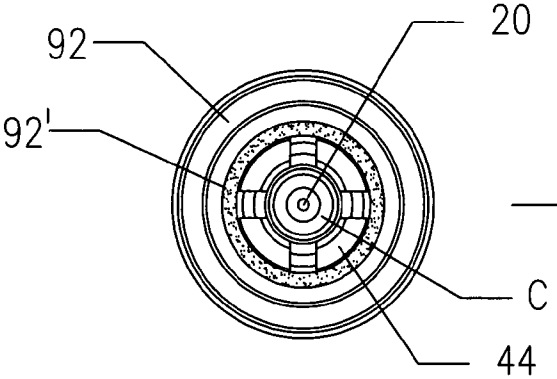
Figure 12A:
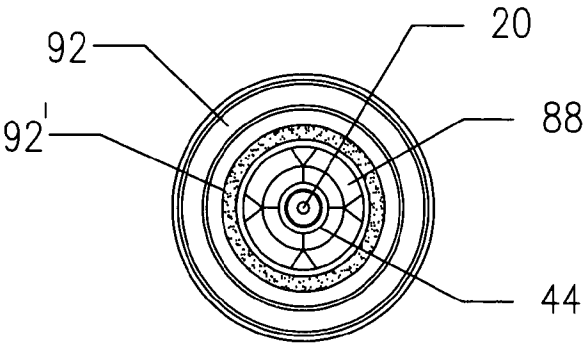

A resilient band 98 may be inserted into the groove formed between the leading end 97 of the band end 96 and the trailing end of the tapered surface portion 85 when the compression connector has been crimped together into the closed position as illustrated in FIG. 8 and FIG. 12. The band 98 is manually stretchable over the end of the outer connector body 14 and, when released, will contract into the groove as described. The band may be of one of several different colors to signify the intended application of the connector to a particular use. In addition, the crimping ring 92 may be of a selected color which represents the size of cable C for which the connector body 14 is designed and which is visible from the end of the connector body as shown in FIG. 7A as well as the exposed end of the crimping ring 92' as shown in FIG. 7. Similarly, the sleeve 12 may be dyed either at some point along the tubular section 36 or the extension tip 16 to designate the size of cable C for which it is designed.

It is therefore to be understood that while preferred forms of invention are herein set forth and described, the above and other modifications may be made therein without departing from the spirit and scope of the invention as defined by the appended claims and reasonable equivalents thereof.

I claim:

1. An adapter for connecting a male end of a cable to a hollow connector body wherein the cable is of the type having inner and outer concentric electrical conductors, an annular dielectric separating said conductors and an outer jacket of electrically non-conductive material, said inner and outer conductors having exposed portions, said adapter comprising:

a sleeve having a portion of electrically conductive material in surrounding relation to said jacket and contacting said exposed portion of said outer conductor, and first means for limiting inward radial contraction of said sleeve into engagement with said exposed portion of said conductor and said jacket without passing through said jacket into electrical contact with said outer conductor wherein said sleeve is in the form of a straight cylindrical portion at one end, said first means including said straight cylindrical portion being divided into arcuate segments by slots of a predetermined width and wherein the inward radial contraction of said segments is limited by movement of opposed facing edges of adjacent of said segments into abutting relation to one another; and second means including a crimping ring at said one end of said sleeve wherein axial advancement of said crimping ring over said one end of said sleeve imparts inward radial, non-yielding deformation to said sleeve into engagement with said jacket without crushing said outer conductor.

2. An adapter according to claim 1 including an extension tip of electrically conductive material provided with a recess to receive said exposed portion of said inner conductor.

3. An adapter according to claim 1 wherein said arcuate segments include internal circumferentially extending teeth along the greater length of said segments.

4. An adapter according to claim 1 wherein said arcuate segments include internal and external circumferentially extending teeth along the greater length of said segments.

5. An adapter according to claim 3 wherein said connector body includes a clamping sleeve, said clamping sleeve being radially contracted into clamping engagement with said arcuate segments in response to axial advancement of said crimping ring over said clamping sleeve.

6. In an assembly for connecting an end of a coaxial cable to a hollow connector body wherein the cable is of the type having inner and outer concentric electrical conductors, an annular dielectric separating said conductors and an outer jacket of electrically non-conductive material, said inner and outer conductors having exposed portions and said inner conductor projecting beyond said dielectric at one end of said cable, the improvement comprising:

an adapter sleeve of electrically conductive material in electrical contact with said exposed portion of said outer conductor, and means for limiting inward radial contraction of said sleeve into engagement with said exposed portion of said conductor and said jacket without passing through said jacket into electrical contact with said outer conductor whereby to prevent crushing of said dielectric wherein said sleeve is in the form of a straight cylindrical portion at one end, said means including said straight cylindrical portion being divided into arcuate segments by open slots of a predetermined width and wherein the inward radial contraction of said segments is limited by movement of opposed facing edges of adjacent of said segments into abutting relation to one another; and a crimping ring disposed at one end of said connector body, and a clamping sleeve is radially contracted into clamping engagement with said arcuate segments in response to axial advancement of said crimping ring over said clamping sleeve.

7. In an assembly according to claim 6 wherein said open slots are longitudinal slots at one end of said sleeve, and said connector body includes a crimping ring at one end of said body wherein axial advancement of said crimping ring over said end of said body imparts inward radial deformation to said sleeve into engagement with said jacket without crushing said outer conductor.

8. In an assembly according to claim 6 including an extension tip of electrically conductive material provided with a recess at one end to receive said exposed portion of said inner conductor.

9. In an assembly according to claim 6 wherein said arcuate segments are provided with internal and external circumferentially extending teeth extending along the substantial length of said segments.

10. In an assembly for connecting an end of a coaxial cable to a hollow connector body provided with a fastening member at one end for interchangeable connection to one of a plurality of electronic devices, each of said devices having a different application, said cable being of the type having inner and outer concentric electrical conductors, an annular dielectric separating said conductors and an outer jacket of electrically non-conductive material, the improvement comprising:

an adapter sleeve of electrically conductive material contacting an exposed portion of said outer conductor, and means for limiting inward radial deformation of said sleeve into engagement with said jacket while avoiding electrical contact with said outer conductor;

a crimping ring of a selected color representing the size of said cable for which said connector body is designed; and an external color band mounted in a groove on said connector body, said band being of a selected color to signify the intended application of said assembly to a particular use.

11. In an assembly according to claim 10 wherein said band is manually stretchable over said body and releasable to contract into close-fitting engagement with said body.

12. In an assembly according to claim 11 wherein said band has external, circumferentially extending ribs.

13. In an assembly according to claim 12 wherein said body includes an external groove dimensioned to receive said band.

14. In an assembly according to claim 10 wherein said band is stretchable over said body after assembly of said cable into said connector body.

* * * * *